US006667289B2

(12) United States Patent
Harrison et al.

(10) Patent No.: US 6,667,289 B2
(45) Date of Patent: Dec. 23, 2003

(54) LOW RESIDUE AQUEOUS HARD SURFACE CLEANING AND DISINFECTING COMPOSITIONS

(75) Inventors: Kenneth Allen Harrison, Goshen, NY (US); Jeanne Marie Weller, Glen Rock, NJ (US); Ann Marie Lynch, Glen Rock, NJ (US)

(73) Assignee: Reckitt Benckiser Inc., Wayne, NJ (US)

( * ) Notice: Subject to any disclaimer, the term of this patent is extended or adjusted under 35 U.S.C. 154(b) by 214 days.

(21) Appl. No.: 09/988,912

(22) Filed: Nov. 19, 2001

(65) Prior Publication Data

US 2002/0103098 A1 Aug. 1, 2002

Related U.S. Application Data

(63) Continuation of application No. PCT/GB00/01860, filed on May 19, 2000.

(30) Foreign Application Priority Data

May 21, 1999 (GB) ..... 9911816

(51) Int. Cl.[7] ..... C11D 3/48; C11D 1/75; C11D 3/44

(52) U.S. Cl. ..... 510/384; 510/180; 510/191; 510/197; 510/199; 510/237; 510/238; 510/382; 510/391; 510/422; 510/432; 510/490; 510/503; 510/504

(58) Field of Search ..... 510/180, 191, 510/197, 199, 237, 238, 382, 384, 391, 432, 422, 490, 503, 504

(56) References Cited

U.S. PATENT DOCUMENTS

| | | | | |
|---|---|---|---|---|
| 5,522,942 A | | 6/1996 | Graubart et al. | |
| 5,948,741 A | * | 9/1999 | Ochomogo et al. | 510/191 |
| 6,013,615 A | | 1/2000 | Zhou et al. | |
| 6,143,703 A | * | 11/2000 | Cheung et al. | 510/101 |

FOREIGN PATENT DOCUMENTS

| | | |
|---|---|---|
| GB | 2 318 585 A | 4/1998 |
| GB | 2 339 795 A | 2/2000 |
| WO | WO 94/22996 A1 | 10/1994 |
| WO | WO 98/17763 A1 | 4/1998 |
| WO | WO 98/21305 A1 | 5/1998 |
| WO | WO 98/44080 A1 | 10/1998 |

* cited by examiner

*Primary Examiner*—Charles Boyer
(74) *Attorney, Agent, or Firm*—Akin Gump Strauss Hauer & Feld, L.L.P.

(57) ABSTRACT

Aqueous based cleaning compositions simultaneously featuring low residue deposition, sanitization and/or disinfecting of treated hard surfaces, and good cleaning characteristics are provided. The compositions include the following ingredients: (a) a quaternary ammonium surfactant compound having germicidal properties; (b) a surfactant system which includes at least one amine oxide surfactant and at least one further surfactant selected from carboxylates and N-acyl amino acid surfactants; (c) a solvent system containing an alkylene glycol ether solvent further with a $C_1$–$C_6$ alcohol; (d) an alkalizing agent; and (e) water.

20 Claims, No Drawings

LOW RESIDUE AQUEOUS HARD SURFACE CLEANING AND DISINFECTING COMPOSITIONS

CROSS-REFERENCE TO RELATED APPLICATIONS

This application is a continuation of International Application No. PCT/GB00/01860, filed May 19, 2000, which was published in the English language on Nov. 30, 2000 under International Publication No. WO 00/71662 A1 and the disclosure of which is incorporated herein by reference.

BACKGROUND OF THE INVENTION

Cleaning compositions are commercially important products and enjoy a wide field of utility in assisting in the removal of dirt and grime from surfaces, especially glass and glossy hard surfaces (i.e., glazed ceramic tiles, polished metals, enameled metal surfaces, glazed porcelain). While the art is replete with various formulations which provide some cleaning benefit and perhaps some disinfecting benefit to surfaces, there is a real and continuing need for such further formulations.

BRIEF SUMMARY OF THE INVENTION

Thus, it is among the objects of the invention to provide improved aqueous cleaning compositions, which are especially useful in cleaning, especially hard surfaces particularly glass and other glossy hard surfaces. Such a composition is particularly useful for use "as-is" by the ultimate user. It is a further object of the invention to provide a process for cleaning hard surfaces, which process comprises the step of: providing an aqueous cleaning composition as outlined herein, and applying an effective amount of the same to a surface, especially a hard surface requiring such cleaning treatment.

According to one aspect of the present invention there is provided an aqueous cleaning composition which provides sanitizing and/or disinfecting and cleaning characteristics to treated surfaces, particularly hard surfaces, which comprises the following constituents:

(A) a quaternary ammonium surfactant compound having germicidal properties;

(B) a surfactant system which includes at least one amine oxide surfactant, and at least one further surfactant selected from carboxylates and N-acyl amino acid surfactants, especially sarcosinates;

(C) a solvent system containing an alkylene glycol ether solvent further with a $C_1$–$C_6$ alcohol, especially where the $C_1$–$C_6$ alcohol is isopropanol;

(D) an alkalizing agent such as an alkanolamide, especially an alkylamine in particular diethylamine; and (E) water.

The compositions may include one or more further optional additive constituents, sometimes referred to as adjuvants, in minor, but effective amounts. By way of non-limiting example, such optional additives include: coloring agents such as dyes and pigments, fragrances, other pH adjusting agents, pH buffer compositions, chelating agents, rheology modification agents as well as one or more further surfactant compounds, in particular nonionic, amphoteric or zwitterionic surfactant compounds. Desirably, in order to reduce the likelihood of undesired buildup upon treated surfaces, especially hard surfaces, the amounts of these additive constituents are present in only minor amounts, i.e., less than 10%, preferable less than 5% wt. based on the total weight of the aqueous cleaning composition being provided herein. The compositions are characterized in providing a disinfecting effect.

DETAILED DESCRIPTION OF THE INVENTION

The compositions according to the invention include (A) one or more quaternary ammonium surfactant compounds having germicidal properties. Exemplary useful quaternary ammonium compounds and salts thereof include quaternary ammonium germicides which may be characterized by the general structural formula:

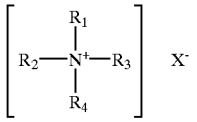

where at least one of $R_1$, $R_2$, $R_3$ and $R_4$ is a alkyl, aryl or alkylaryl substituent of from 6 to 26 carbon atoms, and desirably the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Exemplary counterions include halides, for example chloride, bromide or iodide, or methosulfate or counterions based on saccharides.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

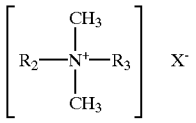

wherein $R_2$ and $R_3$ are the same or different $C_8$–$C_{12}$ alkyl, or $R_2$ is $C_{12-16}$ alkyl, $C_{8-18}$ alkylethoxy, $C_{8-18}$ alkylphenolethoxy and $R_3$ is benzyl, and X is a halide, for example chloride, bromide or iodide, or methosulfate. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Particularly useful quaternary germicides include which are described as being a blend of alkyl dimethyl benzyl ammonium chlorides; BARDAC® 205M, BARDAC® 2050, BARDAC® 2080, BARDAC® 2250, BTC® 812, BTC® 818 and BTC® 1010 which are described as being based on dialkyl($C_8$–$C_{10}$)dimethyl ammonium chloride; BARDAC® 2250 and BARDAC® 2280 or BTC® 1010 which are described as being a composition which includes didecyl dimethyl ammonium chloride; BARDAC® LF and BARDAC® LF 80 which are described as being based on dioctyl dimethyl ammonium chloride; BARQUAT® MB-50, BARQUAT® MB-80, BARQUAT® MX-50, BARQUAT® MX-80, BARQUAT® OJ-50, BARQUAT® OJ-80, BARDAC® 208M, HYAMINE® 3500, HYAMINE® 3500-NF, BTC® 50, BTC® 824, BTC® 835, BTC® 885, BTC® 2565, BTC® 2658, BTC® 8248 or BTC® 8358 each described as being based on alkyl dimethyl benzyl ammonium chloride (benzalkonium chloride); BARQUAT® 4250, BARQUAT® 4280, BARQUAT® 4250Z, BARQUAT® 4280Z, BTC® 471, BTC® 2125, or BTC® 2125M each described as being a composition based on alkyldimethylbenzyl ammonium chloride and/or alkyldimethylethylbenzyl ammonium chloride; BARQUAT® MS-100 or BTC® 324-P-100 each described as being based on myristyldimethylbenzyl ammonium chloride; HYAMINE® 2389 described as being based on methyldodecylbenzyl ammonium chloride and/or methyldodecylxylene-bis-trimethyl ammonium chloride; HYAMINE® 1622 described as being an aqueous solution of benzethonium chloride; as well as BARQUAT® 1552 or BTC® 776 described as being based on alkyl dimethyl benzyl ammonium chloride and/or dialkyl methyl benzyl ammonium chloride, BARQUAT® 50-MAB described as being based on alkyldimethylethyl ammonium bromide and LONZABAC®-12.100 described as being based on an alkyl tertiary amine. Polymeric quaternary ammonium salts based on these monomeric structures are also considered desirable for the present invention. One example is POLYQUAT® described as being a 2-butenyldimethyl ammonium chloride polymer. (Each of these recited materials are presently commercially available from Lonza, Inc., Fairlawn, N.J. and/or from Stepan Co., Northfield Ill.).

In the cleaning compositions according to the invention, the quaternary ammonium compound constituent is required to be present in amounts which are effective in exhibiting satisfactory germicidal activity against selected bacteria sought to be treated by the cleaning compositions. Such efficacy may be achieved against less resistant bacterial strains with only minor amounts of the quaternary ammonium compounds being present, while more resistant strains of bacteria require greater amounts of the quaternary ammonium compounds in order to destroy these more resistant strains. The quaternary ammonium compound need only pre present in germicidally effective amounts, and usually is present in an amount of from about 0.001% wt. to about 5% wt. Desirably the quaternary ammonium compound is present in an amount of from about 0.0025% wt. to about 0.5% wt, and yet more desirably from 0.0025% wt. to 0.3% wt. based on the total weight of the inventive compositions being taught herein.

The compositions of the invention further include a (B) surfactant system which includes at least one amine oxide surfactant, and at least one further surfactant selected from carboxylates and N-acyl amino acid surfactants.

Exemplary useful amine oxide surfactants which may be used in the present compositions include many of which are known to the art. One general class of useful amine oxides include alkyl di(lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl dimethyl amine oxide, myristyl dimethyl amine oxide, dimethyl cocoamine oxide, dimethyl (hydrogenated tallow) amine oxide, and myristyl/palmityl dimethyl amine oxide.

A further class of useful amine oxides includes alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallow amine oxide, and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide.

Additional useful amine oxides include those which may be referred to as alkylmorpholine oxides in which the alkyl group has about 10–20, and preferably 12–16 carbon atoms, and can be straight or branched chain, saturated or unsaturated. Surfactant compositions based on amine oxides include those which are presently commercially available and include those under the trade name Ammonyx® (Stepan Co., Chicago Ill.), as well as Barlox® (Lonza Inc., Fairlawn N.J.).

Particularly advantageous are lauryl dialkyl amine oxides, particularly lauryl dimethyl amine oxides. The amine oxide surfactants are advantageously present in an amount of from about 0.001% wt. to about 5% wt. Desirably however they are present in amount of from 0.01% wt. to 1% wt., but most advantageously they are present in amounts of from 0.05–0.5% wt.

In addition to the at least one amine oxide surfactant the inventive compositions further include at least one further surfactant selected from carboxylates and N-acyl amino acid surfactants.

Exemplary useful carboxylates include alkylethercarboxylates. Useful alkylethercarboxylate surfactants include compounds according to the formula:

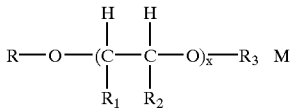

where:

R is a $C_4$–$C_{22}$ linear or branched alkyl group, preferably $C_8$–$C_{15}$ linear or branched alkyl group, and yet more preferably a $C_{12-15}$ linear or branched alkyl group;

X is an integer from 1 to 24, $R_1$, $R_2$ and $R_3$ is a group selected from H, lower alkyl radicals including methyl and ethyl radicals, carboxylate radicals including acetate and propionate radicals, succinate radicals, hydroxysuccinate radicals, or mixtures thereof wherein at least one $R_1$, $R_2$ or $R_3$ is a carboxylate, succinate or hydroxysuccinate radical; and, $M^+$ is a counterion including an alkali metal or ammonium counterion.

Free acid forms of the alkylethercarboxylate compounds noted above may also be used.

Preferably, the alkylethercarboxylate compound is one wherein: R is $C_{12}$–$C_{15}$, x is an integer from 1–20 inclusive, and $R_1$, $R_2$, and $R_3$, which may be the same or different, are preferably selected from H and carboxylate radicals. Most preferred are alkylethercarboxylate compounds, wherein: R is $C_{12}$–$C_{15}$, x is an integer from 5–15 inclusive, and $R_1$ and $R_2$ are both hydrogen, and $R_3$ is a $CH_2COO$— radical, and $M^+$ is a counterion selected from sodium, potassium and ammonium counterions.

Such alkylethercarboxylate compounds are per se known and are available in commercial preparations wherein they are frequently provided with an aqueous carrier. Examples of such presently available commercial preparations include SURFINE WLG (Finetex Inc., Elmwood Park N.J.), SANDOPAN LS-24 (Clariant Chem.Co., Charlotte N.C.) in salt forms, and in free acid forms include those marketed under the tradename NEODOX (Shell Chemical Co., Houston Tex.).

When present in the inventive compositions, the alkylethercarboxylates are present in an amount of from about 0.001% wt. to about 0.1% wt, and yet more desirably from 0.0025% wt. to 0.50% wt., and still most preferably in an amount of from 0.01% wt. to 0.3% wt. based on the total weight of the inventive compositions being taught herein.

The present inventive composition may include an N-acyl amino acid surfactants as part of the (B) surfactant system. N-acyl amino acid surfactants, for purposes hereof, include N-acyl hydrocarbyl acids and salts thereof, such as those represented by the following formula:

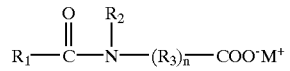

wherein:

$R_1$ is a $C_8$–$C_{24}$ alkyl or alkenyl radical, preferably a $C_{12}$–$C_{18}$ alkyl or alkenyl radical;

$R_2$ is hydrogen, $C_1$–$C_4$ alkyl, phenyl, or —$CH_2COOM$, but preferably is $C_1$–$C_4$ alkyl;

$R_3$ is —$CR'_2$— or $C_1$–$C_2$ alkoxy, wherein each R' independently is hydrogen, or $C_1$–$C_6$ alkyl or alkylester;

n is from 1 to 4, preferably 1 or 2; and,

M is hydrogen or a cation such as such as alkali metal or alkaline earth metal, but preferably is an alkali metal such as sodium or potassium.

According to certain particularly preferred embodiments, the N-acyl amino acid surfactants are those according to the formula indicated above, wherein $R_2$ is methyl, $R_3$ is —$CH_2$— and n is 1. Such compounds are know to the art as N-acyl sarcosinates, and acids thereof.

Specific examples of such N-acyl sarcosinates include lauroyl sarcosinate, myristoyl sarcosinate, cocoyl sarcosinate, and oleoyl sarcosinate, preferably in their sodium and potassium salt forms. Of these, sodium lauroyl sarcosinate is particularly preferred. By way of non-limiting example, certain preferred and commercially available sarcosinates include sodium lauroyl sarcosinates commerically available as Maprosyl® 30 (ex. Stepan Co.); Vanseal® NALS-30 (ex. R. T. Vanderbilt Co.) and Hamposyl® L-30 (ex. Hampshire Chemical Co.). These are frequently supplied as salts, especially as alkaline or alkaline earth metal salts.

For the purposes of the surfactants described herein, it should be understood that the terms "alkyl" or "alkenyl" include mixtures of radicals which may contain one or more intermediate linkages such as ether or polyether linkages or non-functional substituents such as hydroxyl or halogen radicals wherein the radical remains of hydrophobic character.

According to certain preferred embodiments, either the alkylethercarboxylate or the N-acyl amino acid surfactant, but not both, are present in the (B) surfactant system which however at all times includes the amine oxide.

The compositions of the invention include (C) a solvent system containing an alkylene glycol ether solvent and a $C_1$–$C_6$ alcohol, especially isopropanol. Particularly useful alkylene glycol ethers include $C_3$–$C_{20}$ glycol ethers. Specific illustrative examples of useful alkylene glycol ether solvents include: propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Preferably, the (C) solvent system includes propylene glycol n-butyl ether and in certain especially preferred embodiments propylene glycol n-butyl ether is the sole glycol ethers of the (C) solvent system. Propylene glycol n-butyl ether is known to the art. It is commercially available as Dowanol® PnB (ex. Dow Chem. Co., Midland, Mich.). The propylene glycol n-butyl ether may be present in amounts of from 0.01% wt.-10% wt., however is advantageously present in amounts of from 0.01–6% wt.

The inventors find that the compositions of the present application will have the typical and desirable evaporation and drying properties (e.g., no streaking, no mottling, uniform drying) normally found with hard surface cleaners.

The compositions of the invention also include a $C_1$–$C_6$ alcohol as part of the (C) solvent system. Such include for example methanol, ethanol, n-propanol, isopropanol as well as the various positional isomers of butanol, pentanol and hexanol. The inclusion of such alcohols have been found by the present inventors to even further improve in the evaporation of the inventive composition in a relatively even manner such that it tends to form a relatively uniform film layer during the drying process. This effect has been generally described above in conjunction with glycol n-butyl ethers. A further benefit of the inclusion of such alcohols is in the solvency which they may provide to certain stains as well. Of these, the inclusion of isopropanol is most preferred. The $C_1$–$C_6$ alcohol may be present in amounts of from 0.01% wt.-10% wt., however is advantageously present in amounts of from 0.01–6% wt.

According to certain particularly preferred embodiments, the solvent system (C) consists solely of propylene glycol n-butyl ether and isopropanol to the exclusion of other $C_1$–$C_6$ alcohols.

The inventive compositions also include (D) one or more alkalizing agents, including alkylamines, such as, for example, mono-, di- and tri-alkylamines. By way of non-limiting example, these include: methylamine, dimethylamine, methylethylamine, ethylamine, diethylamine, 1-aminopropane, propylamine, di-n-propylamine, 2-aminopropane, diisopropylamine, 1-aminobutane, di-n-butylamine, 2-aminobutane, isobutylamine, diisobutylamine as well as others. Other alkalizing agents which may also be used are alkanolamines, such as, for example, mono-, di-, and trialkanolamines such as monoethanolamine, diethanolamine, triethanolamine and isopropanolamine. In the inventive compositions, the alkylamine is most desirably diethylamine. The alkylamines are present in the inventive compositions in amounts of from 0.001% wt.–10% wt., but more preferably are present in amounts of from 0.001% wt.–3% wt.

As is noted above, the compositions according to the invention are aqueous in nature. Water is added in order to provide to 100% by weight of the compositions of the invention. The water may be tap water, but is preferably distilled and is most preferably deionized water.

Certain preferred embodiments of compositions according to the invention may be categorized as "broad spectrum" disinfecting compositions as they exhibit antimicrobial efficacy against at least *Staphylococcus aureus*, and *Enterobacter aerogenes* in accordance with the "ASTM Standard Test Method for Efficacy of Sanitizers Recommended for Inanimate Non-Food Contact Surfaces" (E 1153-87) known to those skilled in the art. The testing is performed generally in accordance with the protocols outlined in the aforementioned, the contents of which are herein incorporated by reference.

In preferred and especially in most preferred embodiments of the invention the compositions may be characterized in forming a substantially uniform film during drying from a hard surface. More particularly, when preferred compositions of the invention are applied to a hard surface and then formed into a film, such as will be performed by wiping the composition so to generally uniformly spread it onto the hard surface in a thin layer and then permitted to dry, the compositions dry without portions of the uniform film coalescing into droplets or rivulets. The uniform film of the compositions tend to dry in a uniform pattern, generally with noticeable drying beginning at the edges or margins of the uniform film, and proceeding to the central region of the uniform film.

This description may of course vary, particularly where the film formed of the inventive compositions are wiped onto a hard surface but is not formed into a film of generally uniform thickness; in which case drying generally begins at the edges and proceeds to the thicker parts of the film which do not necessarily need to be in the center region. The overall drying effect, that of uniform drying without coalescing into droplets or rivulets however remains the same. Such a behavior is particularly advantageous in the cleaning and/or disinfecting treatment of a hard surface in need of said treatment. Subsequent to application, the composition then tends to dry in a generally uniform manner from a film as described above. This is particularly true where subsequent to an application on a hard surface, such as by spraying, the consumer spreads the deposited composition over a broader area of the hard surface such as by wiping with a rag, towel, paper towel, or the like, which form the composition into a thin film.

The benefits of drying without coalescing into rivulets or droplets also ensures that substantial visually discernible deposits of non-evaporable constituents of the composition do not form. This is a problem with many compositions in the prior art, as during drying form a coalesced rivulet or droplet frequently any non-evaporable constituents deposit at the edges of the coalesced rivulet or droplet and are visible subsequent to drying as an outline of the now evaporated coalesced rivulet or droplet. This results in visibly discernible streaks or a mottled appearance when dried on a hard surface, especially on a highly reflective hard surface such as glazed tile or polished metal surfaces. This is unattractive to the consumer and usually requires a post application buffing or polishing step by the user of a product. This undesirable characteristic is generally avoided by the compositions of the invention, especially in preferred embodiments thereof.

As noted, the compositions may include one or more optional additives which by way of non-limiting example include: coloring agents such as dyes and pigments, fragrances and fragrance solubilizers, pH adjusting agents, pH buffering agents, chelating agents, rheology modification agents, as well as one or more further nonionic surfactant compounds. Desirably, in order to reduce the likelihood of undesired buildup upon treated surfaces, especially hard surfaces, the total amounts of such optional additives is less than about 2.5% wt. but are desirably significantly less, such as less than about 1% wt., and especially less than about 0.5% wt. based on the total weight of the aqueous cleaning and disinfecting composition being provided herein. Optimally, the amounts of such further optional additives is kept to a minimum in order to minimize the amounts of non-volatile constituents in the compositions as a whole, which tend to contribute to an undesired streaky or mottled appearance of the composition during drying.

Useful as chelating agents include those known to the art, including by way of non-limiting example; aminopolycarboxylic acids and salts thereof wherein the amino nitrogen has attached thereto two or more substituent groups. Preferred chelating agents include acids and salts, especially the sodium and potassium salts of ethylenediaminetetraacetic acid, diethylenetriaminepentaacetic acid, N-hydroxyethylethylenediaminetriacetic acid, and of which the sodium salts of ethylenediaminetetraacetic acid may be particularly advantageously used. Such chelating agents may be omitted, or they may be included in generally minor amounts such as from 0–0.5% wt. based on the weight of the chelating agents and/or salt forms thereof. Desirably, such chelating agents are included in the present inventive composition in amounts from 0–0.5% wt., but are most desirably present in reduced weight percentages from about 0–0.2% wt.

The compositions according to the invention optionally but desirably include an amount of a pH adjusting agent or pH buffer composition. Such compositions include many which are known to the art and which are conventionally used. By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. Desirably the compositions according to the invention include an effective amount of an organic acid and/or an inorganic salt form thereof which may be used to adjust and maintain the pH of the compositions of the invention to the desired pH range. Particularly useful is citric acid and metal salts thereof such as sodium citrate which are widely available and which are effective in providing these pH adjustment and buffering effects. These should be screened however to ensure that they do not undesirably complex with or in other ways deactivate the quaternary ammonium compound(s).

Further optional, but advantageously included constituents are one or more coloring agents which find use in modifying the appearance of the compositions and enhance their appearance from the perspective of a consumer or other end user. Known coloring agents may be incorporated in the compositions in any effective amount to improve or impart to compositions a desired appearance or color. Such a coloring agent or coloring agents may be added in a conventional fashion, i.e., admixing to a composition or blending with other constituents used to form a composition.

Further optional, but desirable constituents include fragrances, natural or synthetically produced. Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

In addition to a fragrance, it is frequently desirable to include a fragrance solubilizer which assists in the dispersion, solution or mixing of the fragrance constituent in an aqueous base. These include known art compounds, including condensates of 2 to 30 moles of ethylene oxide with sorbitan mono- and tri-$C_{10}$–$C_{20}$ alkanoic acid known to be useful as nonionic surfactants. Further examples of such suitable surfactants include water soluble nonionic surfactants of which many are commercially known and by way of non-limiting example include the primary aliphatic alcohol ethoxylates, secondary aliphatic alcohol ethoxylates, alkylphenol ethoxylates and ethylene-oxide-propylene oxide condensates on primary alkanols, and condensates of ethylene oxide with sorbitan fatty acid esters. This fragrance solubilizer component is added in minor amounts, particularly amount which are found effective in aiding in the solubilization of the fragrance component, but not in any significantly greater proportion, such that it would be considered as a detergent constituent. Such minor amounts recited herein are generally up to about 0.3% by weight of the total composition but is more generally an amount of about 0.1% by weight and less, and preferably is present in amounts of about 0.05% by weight and less.

As a further optional constituent the present inventors have found that where the compositions include an alkylethercarboxylate, the properties of the compositions are improved by the addition of a minor amount of an ethylene glycol monohexyl ether (Hexyl Cellosolve®, ex. Union Carbide Corp.), as well as other surfactants which can be used for solubilization, or both. One example of such other surfactants can be a blend of cationic surfactants, such as, for example, Videt® QX9, which has been identified as a proprietary blend of cationic surfactants (available from VITECH International, Jamesville, Wis.). When the ethylene glycol monobutyl ether is present, it can be present in an amount of from 0.0–5.0% wt. but most desirably is present in an amount of from 0.0–0.50% wt. When the additional surfactant is present, it is present in an amount of from 0.0–2.0% wt. but most desirably is present in an amount of from 0.0–0.050% wt. According to a particularly preferred embodiment, the inventive composition includes an alkylethercarboxylate, ethylene glycol monohexyl ether, the Videt® QX9 surfactant but does not include an N-acyl amino acid surfactant.

As an optional constituent, the compositions may include one or more nonionic surfactant compounds in amounts which are effective in improving the overall cleaning efficacy of the compositions being taught herein, while at the same time in amounts which do not undesirably diminish the germicidal efficacy of the inventive compositions or which undesirably increase the likelihood to form or deposit surface residues onto the treated surfaces. Such nonionic surfactant compounds are known to the art. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may be varied. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

To be mentioned as particularly useful nonionic surfactants are alkoxylated linear primary and secondary alcohols such as those commercially available under the tradenames PolyTergent® SL series (Olin Chemical Co., Stamford Conn.), Neodol® series (Shell Chemical Co., Houston Tex.); as alkoxylated alkyl phenols including those commercially available under the tradename Triton® X series (Union Carbide Chem. Co., Danbury Conn.).

Such constituents as described above as essential and/or optional constituents include known art compositions, include those described in *McCutcheon's Emulsifiers and Detergents* (*Vol.* 1), *McCutcheon's Functional Materials* (*Vol.* 2), North American Edition, 1991; *Kirk-Othmer, Encyclopedia of Chemical Technology,* 3rd Ed., Vol. 22, pp. 346–387, the contents of which are herein incorporated by reference.

In accordance with a certain preferred embodiment of the inventive composition, there is provided low residue ready to use aqueous hard surface cleaning and broad spectrum sanitizing and/or disinfecting composition comprising per 100% wt., (preferably consisting essentially of), per 100% wt:

(A) 0.0025–0.30% wt. of a quaternary ammonium surfactant compound having germicidal properties;

(B) an surfactant system which includes 0.05–0.50% wt. of at least one amine oxide surfactant, and at least one further surfactant selected from alkylether carboxylates and N-acyl amino acid surfactants;

(C) a solvent system containing 0.01–6.0% wt. of propylene glycol n-butyl ether further with 0.01–6% wt. of a $C_1$–$C_6$ alcohol, especially isopropanol;

(D) 0.001–0.10% wt. of an alkylamine, especially diethylamine; and (E) to 100% wt. water.

wherein the compositions are characterized by forming a substantially uniform film during evaporative drying after being applied to a hard surface, and which may further include from 0.0–10% wt. of one or more optional additives.

In accordance with a further preferred embodiment of the inventive composition, there is provided a low residue ready to use aqueous hard surface cleaning and broad spectrum disinfecting composition comprising per 100% wt., (preferably consisting essentially of), per 100% wt:

(A) 0.0025–0.30% wt. of a quaternary ammonium surfactant compound having germicidal properties;

(B) an surfactant system which includes 0.05–0.50% wt. of at least one amine oxide surfactant, and at least one alkylethercarboxylate surfactant;

(C) a solvent system containing 0.01–6.0% wt. of propylene glycol n-butyl ether further with 0.01–6% wt. of a $C_1$–$C_6$ alcohol, especially isopropanol;

(D) 0.001–0.10% wt. of an alkylamine, especially diethylamine; and (E) to 100% wt. water, an ethylene glycol monohexyl ether, and Videt® QX9 surfactant.

wherein the compositions are characterized by forming a substantially uniform film during evaporative drying after being applied to a hard surface, and which may further include from 0.0–10% wt. of one or more optional additives.

According to a still further certain preferred embodiment of the inventive composition, there is provided low residue ready to use aqueous hard surface cleaning and broad spectrum disinfecting composition comprising per 100% wt., (preferably consisting essentially of), per 100% wt:

(A) 0.0025–0.30% wt. of a quaternary ammonium surfactant compound having germicidal properties;

(B) an surfactant system which includes 0.05–0.50% wt. of at least one amine oxide surfactant, and a N-acyl amino acid surfactant, preferably a sarcosinate surfactant.

(C) a solvent system containing 0.01–6.0% wt. of propylene glycol n-butyl ether further with 0.01–6% wt. of a $C_1$–$C_6$ alcohol, especially isopropanol;

(D) 0.001–0.10% wt. of an alkylamine, especially diethylamine; and (E) to 100% wt. water.

wherein the compositions include no further organic solvents, especially no further glycol ethers, and are characterized by forming a substantially uniform film during evaporative drying after being applied to a hard surface, and which may further include from 0.0–10% wt. of one or more optional additives.

The compositions of the invention can be prepared in a conventional manner such as by simply mixing the constituents in order to form the ultimate aqueous cleaning composition. The order of addition is not critical.

The compositions according to the invention are useful in the cleaning and/or sanitizing of surfaces, especially hard surfaces, having deposited soil thereon. The compositions are particularly effective in the removal of oleophilic soils (viz., oily soils) particularly of the type which are typically encountered in kitchens and other food preparation environments. In such a process, cleaning and disinfecting of such surfaces comprises the step of applying a soil releasing and disinfecting effective amount of a composition as taught herein to such a soiled surface. Afterwards, the compositions are optionally but desirably wiped, scrubbed or otherwise physically contacted with the hard surface, and further optionally, may be subsequently rinsed from such a cleaned and disinfected hard surface.

The hard surface cleaner composition provided according to the invention can be desirably provided as a ready to use product in a manually operated spray dispensing container and is thus ideally suited for use in a consumer "spray and wipe" application. In such an application, the consumer generally applies an effective amount of the cleaning composition using the pump and within a few moments thereafter, wipes off the treated area with a rag, towel, or sponge, usually a disposable paper towel or sponge. To ensure effective sanitization or disinfection, a longer contact time, generally of 10 minutes is required.

In a yet a further embodiment, the compositions according to the invention may be formulated so that they may be useful in conjunction with an "aerosol" type product wherein they are discharged from a pressurized aerosol container. If the inventive compositions are used in an aerosol type product, it is preferred that corrosion resistant aerosol containers such as coated or lined aerosol containers be used. Such are preferred as they are known to be resistant to the effects of acidic formulations. Known art propellants such as liquid propellants as well as propellants of the non-liquid form, i.e., pressurized gases, including carbon dioxide, air, nitrogen, hydrocarbons as well as others may be used. Also, while satisfactory for use, fluorocarbons may be used as a propellant but for environmental and regulatory reasons their use is preferably avoided.

The composition of the present invention, whether as described herein or in a concentrate or super concentrate form, can also be applied to a hard surface by using a wet wipe. The wipe can be of a woven or non-woven nature. Fabric substrates can include nonwoven or woven pouches, sponges, in the form of abrasive or non-abrasive cleaning pads. Such fabrics are known commercially in this field, and are often referred to as wipes. Such substrates can be resin-bonded, hydro-entangled, thermally bonded, melt-blown, needle-punched or any combination of the former.

The nonwoven fabrics may be a combination of wood pulp fibers and textile length synthetic fibers formed by well known dry-form or wet-lay processes. Synthetic fibers such as rayon, nylon, orlon and polyester as well as blends thereof can be employed. The wood pulp fibers should comprise about 30 to about 60 percent by weight of the nonwoven fabric, preferably about 55 to about 60 percent by weight, the remainder being synthetic fibers. The wood pulp fibers provide for absorbency, abrasion and soil retention whereas the synthetic fibers provide for substrate strength and resiliency.

The substrate of the wipe may also be a film forming material such as a water soluble polymer. Such self-supporting film substrates may be sandwiched between layers of fabric substrates and heat sealed to form a useful substrate. The free standing films can be extruded utilizing standard equipment to devolatilize the blend. Casting technology can be used to form and dry films, or a liquid blend can be saturated into a carrier and then dried in a variety of known methods.

The compositions of the present invention are absorbed onto the wipe to form a saturated wipe. The wipe can then be sealed individually in a pouch, which can then be opened when needed, or a multitude of wipes can be placed in a container for use on an as-needed basis. The container, when closed, is sufficiently sealed to prevent evaporation of any components from the compositions.

Whereas the present invention is intended to be produced and provided in the "ready-to-use" form described above, nothing in this specification shall be understood as to limit the use of the composition according to the invention with a further amount of water to form a cleaning solution therefrom. The aqueous compositions according to the invention may be used, and are preferably used "as-is" without further dilution, they may also be used with a further aqueous dilution. Such dilutions include ratios (w %/w %, or v %/v %) of composition:water concentrations of from 1:0, to extremely dilute dilutions such as 1:10,000. Desirably however, in order to ensure disinfection, the compositions should be used "as is", that is to say without further dilution.

The following examples illustrate the superior properties of the formulations of the invention and particular preferred embodiments of the inventive compositions. The terms "parts by weight" or "percentage weight" are used interchangeably in the specification and in the following Examples wherein the weight percentages of each of the individual constituents are indicated in weight percent based on the total weight of the composition of which it forms a part, unless indicated otherwise.

EXAMPLES 1–4

Exemplary formulations illustrating certain preferred embodiments of the inventive compositions and described in more detail in Table 1 below were formulated generally in accordance with the following protocol.

Into a suitably sized vessel, a measured amount of water was provided after which the constituents were added in the following sequence: surfactants, solvents followed by the remaining constituents, including any optional constituents. All of the constituents were supplied at room temperature, and mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well-mixed characteristics (i.e., stable mixtures) upon standing. It is to be noted that the constituents might be added in any order, but it is preferred that water be the initial constituent provided to a mixing vessel or apparatus as it is the major constituent and addition of the further constituents thereto is convenient.

The exact compositions of the example formulations are listed on Table 1, below wherein are indicated the weight percentages of the individual constituents, based on a total weight of 100% weight.

TABLE 1

| | Ex. 1 | Ex. 2 | Ex. 3 | Ex. 4 |
|---|---|---|---|---|
| quaternary ammonium | 0.01 | 0.01 | 0.01 | 0.01 |
| sodium ether carboxylate | 0.05 | 0.05 | 0.05 | — |
| sodium lauryl sarcosinate | — | — | — | 0.008 |
| lauryl amine oxide | 0.050 | 0.05 | 0.10 | 0.10 |
| VIDET QX9 | 0.05 | 0.05 | — | — |
| ethylene glycol monohexyl ether | 0.50 | 0.50 | — | — |
| propylene glycol n-butyl ether | 1.50 | 0.25 | 2.00 | 2.00 |
| isopropanol | 3.50 | 5.75 | 3.50 | 3.50 |
| diethylamine | 0.05 | 0.05 | 0.10 | 0.05 |
| di water | q.s. | q.s. | q.s. | q.s. |

The amounts indicated on Table 1 relating to each constituent indicate the "active basis" weight of the constituent in a commercial preparation. The amount of the actives portion within each of the commercial preparations may be less than, or equal to 100% wt., and the actual amounts of the actives present within each commercial preparation is indicated on Table 2, following. The specific identity of the particular constituents recited in Table 1 are also disclosed in Table 2 below.

TABLE 2

| | |
|---|---|
| quaternary ammonium | Didecyl dimethyl ammonium chloride, BTC ® 1010, 50% wt. actives (ex., Stepan Co.) |
| sodium ether carboxylate | Sandopan ® LS-24, 69% wt. actives (ex. Clariant Corp.) |
| sodium lauryl sarcosinate | Maprosyl ® 30, 30% wt. actives (ex. Stepan Co.) |
| lauryl amine oxide | Ammonyx ® LO, 30% wt. actives (ex., Stepan Co.) |
| VIDET QX9 | Proprietary cationic surfactant blend, 90% wt. actives (ex., VITECH International) |
| Hexyl Cellosolve | Ethylene glycol monohexyl ether, 100% wt. actives (ex. Union Carbide) |
| propylene glycol n-butyl ether | Supplied as Dowanol ® PnB, 100% wt. actives, (ex., Dow Chemical Co.) |
| isopropanol | Isopropanol, 100% wt. actives |
| diethylamine | Diethylamine, 100% wt. actives (ex., BASF) |
| di water | Deionized water |

The compositions of Table 1 were evaluated in accordance with one or more of the further tests described below.

Evaluation of Antimicrobial Efficacy:

Several of the exemplary formulations of Table 1 above were evaluated in order to evaluate their antimicrobial efficacy against *Staphylococcus aureus* (gram positive type pathogenic bacteria) (ATCC 6538), and *Enterobacter aerogenes aureus* (gram negative type pathogenic bacteria) (ATCC 13048) in accordance with the "ASTM Standard Test Method for Efficacy of Sanitizers Recommended for Inanimate Non-Food Contact Surfaces, E 1153-87). As is appreciated by the skilled practitioner in the art, the results of this test indicates log reduction of test organisms which are subjected to a test composition. The results of the antimicrobial testing are indicated on Table 3, below.

TABLE 3

| Formula: | Log 10 recovery | Log 10 reduction |
|---|---|---|
| *Enterobacter aerogenes* | | |
| Ex. 1 | 0 | 5.46 |
| Ex. 2 | 0 | 5.46 |
| Ex. 3 | 0 | 5.46 |
| Ex. 4 | 0 | 5.46 |
| Control | 5.46 | n/a |
| *Staphylococcus aureus* | | |
| Ex. 1 | 2.6 | 3.29 |
| Ex. 2 | 0 | 5.89 |
| Ex. 3 | 0 | 5.89 |
| Ex. 4 | 1.02 | 4.87 |
| Control | 5.89 | n/a |

As a control, ("Control" in Table 3) an aqueous composition containing 0.01% wt. of an ethoxylated phenolic surfactant (Triton-X100®, ex. Union Carbide) was also tested. As may be seen from the results indicated above, the compositions according to the invention provide excellent sanitization of hard surfaces, while the compositions based on the ethoxylated phenolic surfactant performed poorly.

Evaluation of Cleaning Efficacy:

The compositions according the invention are expected to provide good cleaning.

Evaluation of Evaporation and Drying Characteristics:

The compositions according to the invention are expected to have good evaporation and drying characteristics.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. A low residue aqueous hard surface cleaning and sanitizing and/or disinfecting composition which comprises:

(A) a quaternary ammonium surfactant compound having germicidal properties;

(B) a surfactant system which includes at least one amine oxide surfactant and at least one further surfactant selected from carboxylates and N-acyl amino acid surfactants;

(C) a solvent system containing an alkylene glycol ether solvent further with a $C_1$–$C_6$ alcohol;

(D) an alkalizing agent; and (E) water;

wherein the composition forms a substantially uniform film during evaporative drying subsequent to application on a hard surface.

2. The low residue aqueous hard surface cleaning and disinfecting composition according to claim 1, wherein the surfactant (B) is solely an amine oxide and an alkylether-carboxylate.

3. The low residue aqueous hard surface cleaning and disinfecting composition according to claim 1, wherein the surfactant (B) is solely an amine oxide and an N-acyl amino acid surfactant.

4. The low residue aqueous hard surface cleaning and disinfecting composition according to claim 3, wherein the N-acyl amino acid surfactant is a sarcosinate.

5. A low residue aqueous hard surface cleaning and disinfecting composition according to claim 1, wherein the solvent system (C) consists solely of propylene glycol n-butyl ether and isopropanol.

6. The low residue aqueous hard surface cleaning and disinfecting composition according to claim 1, wherein the alkalizing agent is an alkylamine.

7. The low residue aqueous hard surface cleaning and disinfecting composition according to claim 6, wherein the alkalizing agent is a diethylamine.

8. The low residue hard surface cleaning and disinfecting composition according to claim 1, wherein the quaternary ammonium germicide is in accordance with the following general structural formula:

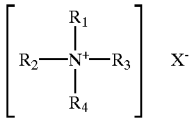

where:

at least one of $R_1$, $R_2$, $R_3$ and $R_4$ is an alkyl, aryl or alkylaryl substituent of from 6 to 26 carbon atoms, which may include one or more amide, ether or ester linkages;

remaining R1, R2, R3 and R4 are straight-chained or branched hydrocarbons usually containing not more than 12 carbon atoms, which may include one or more amide, ether or ester linkages; and X is a salt-forming anion.

9. The low residue hard surface cleaning and disinfecting composition according to claim 8, wherein the quaternary ammonium germicide is in accordance with the following general structural formula:

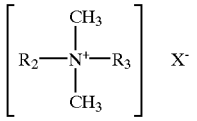

where:

$R_2$, $R_3$ may be $C_8$–$C_{12}$ alkyl, or when $R_2$ is $C_{12-16}$ alkyl, $C_{8-18}$ alkylethoxy, $C_{8-18}$ alkylphenolethoxy, $R_3$ is benzyl; and X is a halide ion.

10. The composition according to claim 1, comprising per 100%wt.:

(A) 0.0025–0.30%wt. of a quaternary ammonium surfactant compound having germicidal properties;

(B) a surfactant system which includes 0.05–0.50%wt. of at least one amine oxide surfactant, and at least one further surfactant selected from alkylether carboxylates and N-acyl amino acid surfactants;

(C) a solvent system containing 0.01–6.0%wt. of propylene glycol n-butyl ether further with 0.01–6%wt. of a C1–C6 alcohol;

(D) 0.001–0.10%wt. of an alkalizing agent; and (E) to 100%wt. water.

11. The composition according to claim 1, comprising per 100%wt.:

(A) 0.0025–0.30%wt. of a quaternary ammonium surfactant compound having germicidal properties;

(B) a surfactant system which includes 0.05–0.50%wt. of at least one amine oxide surfactant, and an N-acyl amino acid surfactant;

(C) a solvent system containing 0.01–6.0%wt. of propylene glycol n-butyl ether further with 0.01–6%wt. of a $C_1$–$C_6$ alcohol;

(D) 0.001–0.10%wt. of an alkalizing agent; and (E) to 100%wt. water.

12. A process for the cleaning and sanitizing and/or disinfecting of a hard surface in need of such treatment which comprises the step of:

applying an effective amount of the composition according to claim 1.

13. A low residue cleaning and sanitizing and/or disinfecting composition consisting essentially of:

(A) a quaternary ammonium surfactant compound having germicidal properties;

(B) a surfactant system which includes at least one amine oxide surfactant and at least one further surfactant selected from the group consisting of carboxylates and N-acyl amino acid surfactants;

(C) a solvent system containing an alkylene glycol ether solvent further with a $C_1$–$C_6$ alcohol;

(D) an alkalizing agent; and (E) water;

wherein the composition forms a substantially uniform film during evaporative drying subsequent to application on a hard surface.

14. The composition according to claim 13, consisting essentially of per 100 wt %:

(A) 0.0025–0.30 wt % of a quaternary ammonium surfactant compound having germicidal properties;

(B) a surfactant system which includes 0.05–0.50 wt % of at least one amine oxide surfactant, and at least one further surfactant selected from the group consisting of alkylether carboxylates and N-acyl amino acid surfactants;

(C) a solvent system containing 0.01–6.0 wt % of propylene glycol n-butyl ether further with 0.01∝6 wt % of a $C_1$–$C_6$ alcohol;

(D) 0.001–0.10 wt % of an alkalizing agent; and (E) to 100 wt % water.

15. The composition according to claim 13, consisting essentially of per 100 wt %:

(A) 0.0025–0.30 wt % of a quaternary ammonium surfactant compound having germicidal properties;

(B) a surfactant system which includes 0.05–0.50 wt % of at least one amine oxide surfactant and an N-acyl amino acid surfactant;

(C) a solvent system containing 0.01–6.0 wt % of propylene glycol n-butyl ether further with 0.01–6 wt % of a $C_1$–$C_6$ alcohol;

(D) 0.001–0.10 wt % of an alkalizing agent; and (E) to 100 wt % water.

16. The composition according to claim 11, wherein the N-acyl amino acid surfactant is a sarcosinate.

17. The composition according to claim 11, wherein the $C_1$–$C_6$ alcohol is isopropanol.

18. The composition according to claim 15, wherein the N-acyl amino acid surfactant is a sarcosinate.

19. The composition according to claim 15, wherein the $C_1$–$C_6$ alcohol is isopropanol.

20. A process for the cleaning and sanitizing and/or disinfecting of a hard surface in need of such treatment which comprises the step of:

applying an effective amount of the composition of claim 13.

* * * * *